US010919006B2

(12) United States Patent
Logan et al.

(10) Patent No.: US 10,919,006 B2
(45) Date of Patent: Feb. 16, 2021

(54) PROGRESSIVE TANK SYSTEM AND METHOD FOR USING THE SAME

(71) Applicant: Ecolab USA Inc., St. Paul, MN (US)

(72) Inventors: Zachary Wilson Logan, Bar Nunn, WY (US); Richard Lee Binks, Casper, WY (US); Camdon J. DePaolo, Casper, WY (US)

(73) Assignee: ChampionX USA Inc., Sugar Land, TX (US)

( * ) Notice: Subject to any disclaimer, the term of this patent is extended or adjusted under 35 U.S.C. 154(b) by 960 days.

(21) Appl. No.: 15/457,940

(22) Filed: Mar. 13, 2017

(65) Prior Publication Data

US 2017/0259223 A1 Sep. 14, 2017

Related U.S. Application Data

(60) Provisional application No. 62/308,074, filed on Mar. 14, 2016.

(51) Int. Cl.
*B01F 3/12* (2006.01)
*B01F 7/00* (2006.01)
(Continued)

(52) U.S. Cl.
CPC ..... *B01F 3/1228* (2013.01); *B01F 3/1221* (2013.01); *B01F 5/0606* (2013.01); *B01F 5/0607* (2013.01); *B01F 7/22* (2013.01); *B01F 13/103* (2013.01); *B01F 13/1016* (2013.01); *B01F 13/1027* (2013.01); *B01F 13/1033* (2013.01); *B01F 15/00155* (2013.01); *B01F 15/00285* (2013.01); *B01F 15/00831* (2013.01); *B01F 15/00876* (2013.01); *B01F 15/00915* (2013.01); *E21B 21/062* (2013.01); *B01F 2013/1052* (2013.01); *B01F 2215/0049* (2013.01)

(58) Field of Classification Search
None
See application file for complete search history.

(56) References Cited

U.S. PATENT DOCUMENTS 3,725,258 A * 4/1973 Spector ..... C02F 3/12 210/604
3,772,188 A * 11/1973 Edwards ..... A61L 11/00 210/629
(Continued)

FOREIGN PATENT DOCUMENTS

DE 2429393 1/1976
EP 2703598 3/2014
(Continued)

OTHER PUBLICATIONS

Machine translation for FR 1541096 A. Retrieved from EPO website on Apr. 17, 2020. (Year: 2020).*
(Continued)

*Primary Examiner* — Jennifer A Leung
(74) *Attorney, Agent, or Firm* — Merchant & Gould P.C.

(57) ABSTRACT

Embodiments of the present disclosure involve methods, devices, and systems for hydrating polymers using multiple mixing chambers. Adjacent mixing chambers may be coupled using an under-over baffle, and each mixing chamber may be generally rectangular with rounded corners.

13 Claims, 6 Drawing Sheets

(51) Int. Cl.

| | |
|---|---|
| ***B01F 13/10*** | (2006.01) |
| ***B01F 15/02*** | (2006.01) |
| ***B01F 5/06*** | (2006.01) |
| ***E21B 21/06*** | (2006.01) |
| ***B01F 15/00*** | (2006.01) |
| ***B01F 7/22*** | (2006.01) |

(56) References Cited

U.S. PATENT DOCUMENTS

| | | | | |
|---|---|---|---|---|
| 4,141,656 | A | 2/1979 | Mian | |
| 5,203,515 | A | 4/1993 | Stoerzback | |
| 6,402,065 | B1 | 6/2002 | Higgins | |
| 2004/0188334 | A1* | 9/2004 | McWhirter | B01J 19/0066 210/219 |
| 2012/0315675 | A1 | 12/2012 | Medoff et al. | |
| 2015/0352507 | A1 | 12/2015 | Jeronimo et al. | |

FOREIGN PATENT DOCUMENTS

| | | | | |
|---|---|---|---|---|
| FR | 1541096 | A | * 10/1968 | B01F 7/167 |
| GB | 133722 | A | * 10/1919 | B01F 3/04588 |
| GB | 976805 | A | * 12/1964 | C02F 3/1247 |

OTHER PUBLICATIONS

Machine translation for DE 2429393 A1. Retrieved from EPO website on Apr. 17, 2020. (Year: 2020).*

PCT International Search Report and Written Opinion in International Application PCT/US2017/022161, dated May 30, 2017, 13 pages.

PCT International Search Report and Written Opinion in International Application PCT/US2017/022157, dated Jun. 28, 2017, 14 pages.

* cited by examiner

PROGRESSIVE TANK SYSTEM AND METHOD FOR USING THE SAME

CROSS-REFERENCE TO RELATED APPLICATIONS

This application claims priority to and the benefit of U.S. Provisional Patent Applications Ser. No. 62/308,074, filed Mar. 14, 2016, entitled, "PROGRESSIVE TANK SYSTEM AND METHOD FOR USING THE SAME," the disclosure of which is hereby incorporated by reference.

BACKGROUND

The present disclosure involves methods, devices, and systems for hydrating polymers. Conventional flow-through tank techniques for hydrating polymers involve mixing a polymer and liquid by directing the water-wetted dry polymer and liquid in a horizontal direction. Such a design, however, can create a slipstream within the vessels used to hydrate the polymers. This causes some polymers to flow through the tank quicker than intended, which results in polymers that are not hydrated as desired.

It is with respect to these and other considerations that the technology is disclosed. Also, although relatively specific problems have been discussed, it should be understood that the embodiments presented should not be limited to solving the specific problems identified in the introduction.

SUMMARY

Embodiments of the present disclosure involve methods, devices, and systems for hydrating polymers using multiple mixing chambers. Adjacent mixing chambers may be coupled using an under-over baffle, and each mixing chamber may be generally rectangular with rounded corners.

In an Example 1, a system for hydrating a dry polymer comprises a tank assembly having a plurality of mixing chambers, wherein adjacent mixing chambers are operatively coupled by an under-over baffle, and wherein each of the plurality of mixing chambers comprises an open interior bounded by a plurality of walls having a generally rectangular configuration, wherein adjacent walls are coupled by rounded corners; and at least one mixing device disposed within at least one of the plurality of mixing chambers.

In an Example 2, the system of Example 1, wherein the at least one mixing device comprises at least one impeller.

In an Example 3, the system of any of Examples 1 and 2, wherein each of the plurality of mixing chambers comprises: a rectangular front wall; a first side wall oriented substantially perpendicularly to the front wall; a first curved corner wall extending between a first edge of the front wall and a first edge of the first side wall; a second side wall oriented substantially perpendicularly to the front wall; a second curved corner wall extending between a second edge of the front wall and a first edge of the second side wall; a rectangular back wall, parallel to the front wall; a third curved corner wall extending between a first edge of the back wall and a second edge of the first side wall; a fourth curved corner wall extending between a second edge of the back wall and a second edge of the second side wall; and a lower wall coupled to a lower end of each of the front wall, the back wall, and the side walls, wherein the lower wall is oriented substantially perpendicularly to the front, back, and side walls.

In an Example 4, the system of Example 3, the plurality of mixing chambers comprising: a first mixing chamber, comprising: a polymer inlet, through which wetted polymer is provided to the first mixing chamber; and a first baffle inlet defined in a lower portion of the back wall of the first mixing chamber; a second mixing chamber, comprising: a first baffle outlet defined in an upper portion of the front wall of the second mixing chamber; and a second baffle inlet defined in a lower portion of the back wall of the second mixing chamber; wherein a first baffle operatively couples the first mixing chamber to the second mixing chamber, the first baffle comprising a first fluid conduit extending between the first baffle inlet and the first baffle outlet.

In an Example 5, the system of Example 4, the first fluid conduit comprising an open interior region partially enclosed by an outside surface of the back wall of the first mixing chamber, an outside surface of the front wall of the second mixing chamber, two parallel opposed side baffle walls, an upper baffle wall, and a lower baffle wall.

In an Example 6, the system of any of Examples 4 and 5, wherein the first baffle inlet comprises an opening having a first end and a second end, wherein the first end is disposed at or near the first edge of the back wall, and wherein the second end is disposed at or near the second edge of the back wall.

In an Example 7, the system of Example 6, wherein the opening has a rectangular shape or an elliptical shape.

In an Example 8, the system of either of Examples 6 or 7, wherein a size of the opening is adjustable.

In an Example 9, the system of any of Examples 4 through 8, further comprising a level sensor operatively coupled to the first mixing chamber, wherein the level sensor is configured to determine a level of a polymer solution in the first mixing chamber.

In an Example 10, the system of Example 9, further comprising a controller configured to control one or more operations performed by the system, wherein the level sensor is further configured to communicate the determined level of the polymer solution in the first mixing chamber to the controller.

In an Example 11, the system of Example 10, wherein the controller is further configured to implement a feedback control loop based at least in part on the determined level of the polymer solution in the first mixing chamber, wherein the feedback control loop is used to adjust a rate at which the wetted polymer is added to the first mixing chamber.

In an Example 12, the system of any of Examples 4 through 11, wherein the at least one mixing device comprises a first mixing device disposed in the first mixing chamber, and at least one additional mixing device disposed in at least one additional mixing chamber, the first mixing device configured to mix a volume of a polymer solution in the first mixing chamber, and the at least one additional mixing device configured to mix the volume of the polymer solution in the at least one additional mixing chamber.

In an Example 13, the system of Example 12, wherein the first mixing device is configured to mix the volume of polymer solution more aggressively than the at least one additional mixing device.

In an Example 14, the system of any of Examples 12 and 13, wherein the first mixing device is configured to mix the volume of polymer solution by rolling the volume of polymer solution within the first mixing chamber.

In an Example 15, the system of any of Examples 12 through 14, wherein the at least one additional mixing device is configured to mix the volume of polymer solution by stirring the volume of polymer solution within the at least one additional mixing chamber.

In an Example 16, the system of any of Examples 1 through 15, wherein the plurality of mixing chambers comprises at least two mixing chambers.

In an Example 17, the system of Example 16, wherein the plurality of mixing chambers comprises five mixing chambers.

In an Example 18, system of any of Examples 1 through 17, wherein the number of mixing chambers included in the plurality of mixing chambers is based on a property associated with the polymer hydration process.

In an Example 19, the system of Example 18, wherein the property comprises at least one of a minimum desired polymer concentration and a maximum desired polymer concentration.

In an Example 20, the system of any of Examples 18 and 19, wherein the property comprises a fluid pressure.

In an Example 21, a method of hydrating a dry polymer, using a plurality of mixing chambers, wherein adjacent mixing chambers are operatively coupled by an under-over baffle, and wherein each of the plurality of mixing chambers comprises an open interior bounded by a plurality of walls having a generally rectangular configuration, wherein adjacent walls are coupled by rounded corners, comprises: providing a volume of fluid to a first mixing chamber of the plurality of mixing chambers; providing un-hydrated wetted polymer particles to the first mixing chamber to create a volume of polymer solution; rolling, using a first mixing device disposed in the first mixing chamber, the volume of polymer solution; moving the volume of polymer solution from the first mixing chamber into a baffle via a baffle inlet, wherein the baffle inlet is defined in a lower portion of a back wall of the first mixing chamber; and moving the volume of polymer solution through the baffle and into a second mixing chamber of the plurality of mixing chambers via a baffle outlet, wherein the baffle outlet is defined in an upper portion of a front wall of the second mixing chamber.

In an Example 22, the method of Example 21, the baffle comprising an open interior region partially enclosed by an outside surface of the back wall of the first mixing chamber, an outside surface of the front wall of the second mixing chamber, two parallel opposed side baffle walls, an upper baffle wall, and a lower baffle wall.

In an Example 23, the method of any of Examples 21 and 22, further comprising stirring, using a second mixing device disposed in the second mixing chamber, the volume of polymer solution.

In an Example 24, the method of any of Examples 21 through 23, wherein the plurality of mixing chambers comprises at least two mixing chambers.

In an Example 25, the method of Example 24, wherein the plurality of mixing chambers comprises five mixing chambers.

In an Example 26, the method of any of Examples 21 through 25, further comprising determining a number of mixing chambers to include in the plurality of mixing chambers based on a property associated with the polymer hydration process.

In an Example 27, the method of Example 26, wherein the property comprises at least one of a minimum desired polymer concentration and a maximum desired polymer concentration.

In an Example 28, the method of any of Examples 26 and 27, wherein the property comprises a fluid pressure.

In an Example 29, the method of any of Examples 21 through 28, wherein providing the wetted polymer to the first mixing chamber to create a volume of polymer solution comprises: providing the dry polymer to the first mixing chamber at a first rate; determining that a condition is satisfied; and in response to determining that the condition is satisfied, providing the wetted polymer to the first mixing chamber at a second rate.

In an Example 30, the method of Example 29, wherein the first rate is greater than the second rate.

In an Example 31, the method of Example 30, wherein the second rate is no less than about 0.01 wt % and no greater than about 2.0 wt %.

In an Example 32, the method of Example 31, wherein the second rate is between 1.4 wt % and 1.9 wt %.

In an Example 33, the method of Example 32, wherein the second rate is about 1.5 wt %.

In an Example 34, the method of any of Examples 29 through 33, wherein the condition comprises at least one of an amount of time and a level of the polymer solution in the first mixing chamber.

In an Example 35, a system for hydrating a dry polymer comprises: a polymer wetting device configured to dispense a measured amount of a wetted polymer; a tank assembly having a plurality of mixing chambers, wherein adjacent mixing chambers are operatively coupled by an under-over baffle, and wherein each of the plurality of mixing chambers comprises an open interior bounded by four walls, wherein adjacent walls are coupled by rounded corners, the plurality of mixing chambers comprising at least a first mixing chamber and a last mixing chamber, wherein the polymer wetting device is coupled to the first mixing chamber and configured to dispense the measured amount of the wetted polymer into the first mixing chamber; at least one mixing device disposed within at least one of the plurality of mixing chambers; a hydrated polymer discharge mechanism configured to discharge the hydrated polymer from the last mixing chamber; and a controller configured to control operation of at least one of the polymer wetting device, the hydrated polymer discharge mechanism, and the at least one mixing device.

In an Example 36, the system of Example 35, wherein the over-under baffle comprises an inlet having an adjustable size.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

Figure 1:
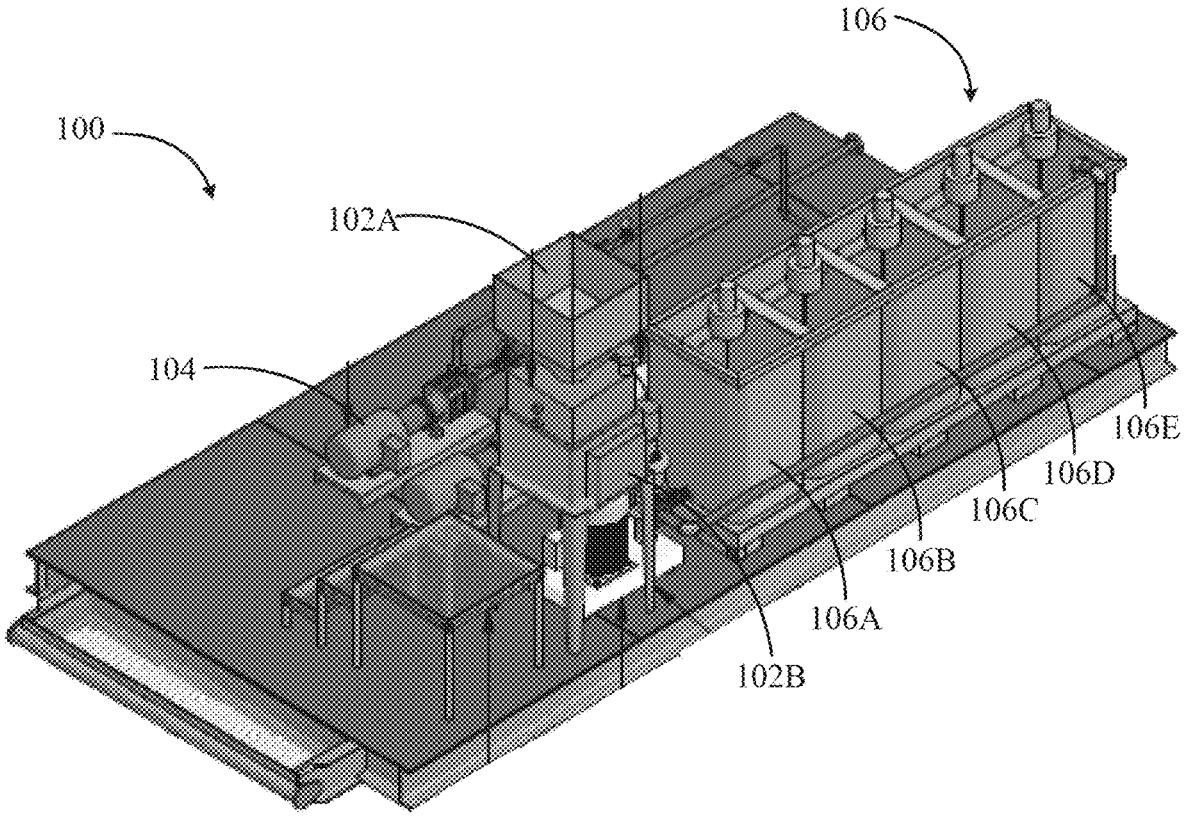
FIG. 1 shows an isometric view of a system for hydrating polymers, in accordance with embodiments of the present disclosure.

While the disclosed subject matter is amenable to various modifications and alternative forms, specific embodiments have been shown by way of example in the drawings and are described in detail below. The intention, however, is not to limit the disclosed subject matter to the particular embodiments described. On the contrary, the disclosure is intended to cover all modifications, equivalents, and alternatives falling within the scope of the disclosed subject matter as defined by the appended claims.

As the terms are used herein with respect to ranges of measurements (such as those disclosed immediately above), "about" and "approximately" may be used, interchangeably, to refer to a measurement that includes the stated measurement and that also includes any measurements that are reasonably close to the stated measurement, but that may differ by a reasonably small amount such as will be understood, and readily ascertained, by individuals having ordinary skill in the relevant arts to be attributable to measurement error, differences in measurement and/or manufacturing equipment calibration, human error in reading and/or setting measurements, adjustments made to optimize performance and/or structural parameters in view of differences in measurements associated with other components, particular implementation scenarios, imprecise adjustment and/or manipulation of objects by a person or machine, and/or the like.

Although the term "block" may be used herein to connote different elements illustratively employed, the term should not be interpreted as implying any requirement of, or particular order among or between, various steps disclosed herein unless and except when explicitly referring to the order of individual steps.

DETAILED DESCRIPTION

Figure 2:
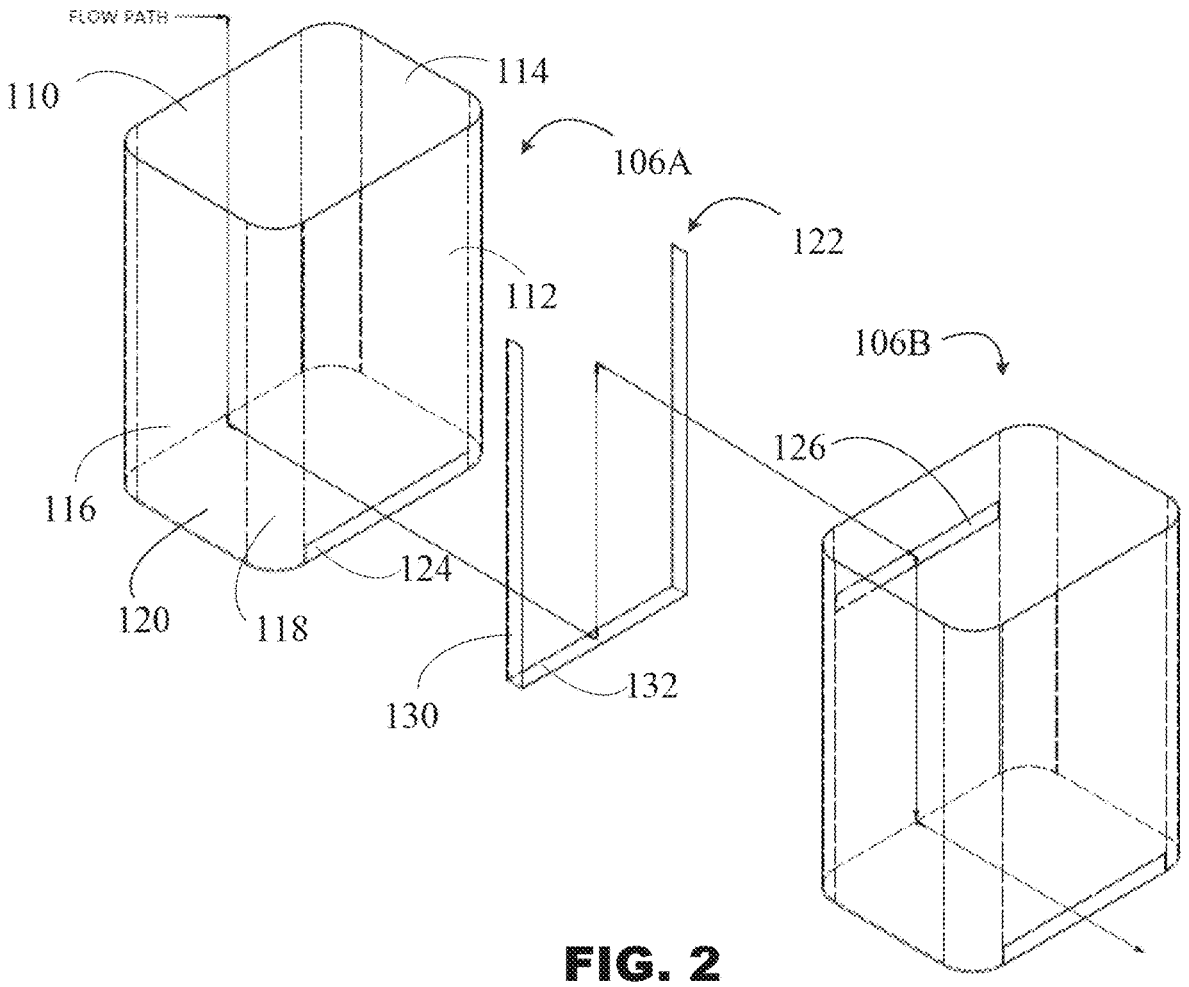
FIG. 2 shows a partial exploded view of the system of FIG. 1.
Figure 3:
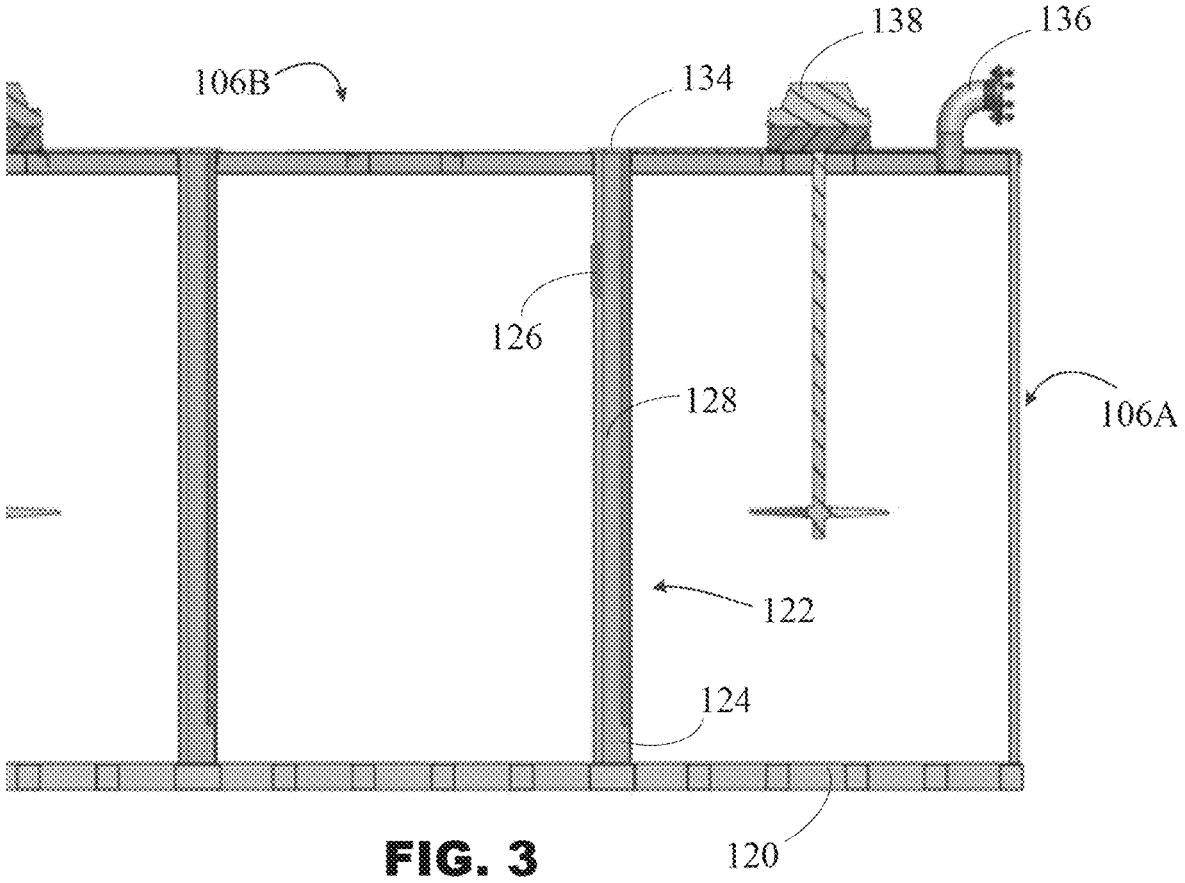
FIG. 3 shows a partial section view of the system of FIG. 1.

The present disclosure involves methods, devices, and systems for hydrating polymers. FIG. 1 shows a system 100 including a hopper 102A and a pump 104 positioned next to a tank assembly 106 having a series of chambers 106A-106E. FIG. 2 shows a partial exploded view of some of the chambers 106A-B, and FIG. 3 shows a partial section view of some of the chambers 106A-B. During operation of the system 100, dry polymer is fed to the hopper 102A and processed (e.g., wetted and sliced) by a polymer wetting device 102B before entering the tank assembly 106. Wetted polymer is mixed with liquid in the tank assembly's series of chambers 106A-E, further wetting the polymer particles, to hydrate the polymer.

The tank assembly 106 includes a plurality of mixing chambers with five 106A-106E being shown in FIG. 1. FIG. 2 shows mixing chambers having an open interior bounded by a plurality of walls forming a generally rectangular configuration. The walls are coupled together with rounded corners. More particularly, the mixing chambers are shown having rectangular front wall 110 and back wall 112, that are positioned parallel to each other. The mixing chamber also includes a first side walls 114 and a second side wall 116 oriented substantially perpendicularly to the front wall 110 and the back wall 112. In aspects of the technology, the walls are coupled together by curved corner walls 118 extending between edges of the walls. A lower wall 120 (e.g., floor, base) is coupled to and oriented substantially perpendicularly to a lower end of each of the front wall 110, the back wall 112, the first side wall 114, and the second side wall 116. In embodiments, each mixing chamber includes and independent lower wall 120, while in other embodiments, the lower wall 120 may be one piece, to which the walls of each mixing chamber are coupled.

The corner walls 118 may have any curvature suitable for providing flow within the liquid to mix the polymer with the liquid. In embodiments, the curvature of the corner walls 118 may be designed, using computational fluid dynamics, to optimize the mixing of a particular type of liquid and/or polymer that may be expected to be provided to the system. In embodiments, for example, squared corners (e.g., corners formed from perpendicularly intersecting walls) have been found to form stagnant regions during mixing, and a round chamber often may result in a uniform spinning motion of the liquid and polymer. Both of these situations may reduce the amount of mixing that occurs in the chamber. Accordingly, a curvature that more approximately results in a generally rectangular chamber with at least slightly rounded corners may provide a more suitable mixing environment.

The illustrative system 100 shown in FIGS. 1-3 is not intended to suggest any limitation as to the scope of use or functionality of embodiments of the present disclosure. Neither should the illustrative system 100 be interpreted as having any dependency or requirement related to any single component or combination of components illustrated therein. Additionally, various components depicted in FIGS. 1-3 may be, in embodiments, integrated with various ones of the other components depicted therein (and/or components not illustrated), all of which are considered to be within the ambit of the present disclosure.

FIGS. 2 and 3 show the first mixing chamber 106A being operatively coupled to the second chamber 106B by an under-over baffle 122 having a fluid conduit positioned between a baffle inlet 124 and outlet 126. The baffle inlet 124 is defined by an opening in a lower portion of the back wall 112 of the first mixing chamber 106A. The adjacent mixing chamber 106B includes the baffle outlet 126 defined by an opening in an upper portion of the front wall 110 of the second mixing chamber 106B. The openings can be rectangular or elliptical shaped, among other shapes, and can extend to, or near, the edges of the back or front walls. A size of the openings may differ from chamber to chamber. For example, a width of the opening and baffle may be larger for chambers positioned later in the series.

The fluid conduit 128 includes an open interior region enclosed by an outside surface of the back wall of the first mixing chamber, an outside surface of the front wall of the second mixing chamber, two parallel opposed side baffle walls 130, a lower baffle wall 132, and an upper baffle wall 134.

While an under-over baffle 122 having a baffle inlet 124 and baffle outlet 126 are shown for the first chamber 106A, it will be appreciate that any chamber of a system 100 may have an under-over baffle system. For example, any of chamber 106B-106E may have an under-over baffle system.

Additionally, FIG. 3 shows the first mixing chamber 106A having a polymer inlet 136 through which wetted polymer (e.g., pre-wet polymers) enters the mixing chamber. In operation, mixing of wetted polymer and liquid may be facilitated by mixing devices 138, although not all chambers require a mixing device 138. Mixing devices 138 are configured to mix wetted polymer and a liquid to hydrate the polymer to create a final polymer solution. For example, mixing devices 138 may mix the polymer and liquid by rolling (e.g., circulating the mixture in vertical directions). Mixing devices 138 may also mix the polymer and liquid by stirring (e.g., circulating the mixture in horizontal directions). FIG. 3 shows a mixing device 138 coupled to a top section of the first mixing chamber 106A and having an impellor.

After mixing in the first chamber 106A, the polymer solution is directed through the under-over baffle 122. For example, the solution flows through the opening 124 in the bottom of the back chamber wall through the fluid conduit 128 and into the second mixing chamber 106B via the opening 126 in the top of the front wall of the second mixing chamber 106B. According to embodiments, under-over baffles may mitigate creation of a slipstream throughout the tank assembly 106. Specifically, with the baffles, there may be no "easy" path for liquid or polymer to travel along in the tank assembly 106 such that polymer is under-hydrated when leaving the assembly 106.

In embodiments, any number of the mixing chambers 106 A-E may include a mixing device 138. In embodiments, for example, each mixing chamber 106 A-E may include a mixing device 138, while in other embodiments, only one of the chambers 106 A-E may include a mixing device 138. For example, the first chamber 106A may include a mixing device 138 while only one other chamber in the tank assembly 106 may utilize a mixing device 138. For example, FIG. 3 shows a second mixing chamber 106B without a mixing device. In certain embodiments, the mixing device 138 in the first chamber 106A may be configured to mix more aggressively than other mixing devices disposed within the tank assembly 106. For example, the polymer solution in the first chamber 106A may be aggressively rolled while solution in later tanks may be stirred before exiting the chamber.

Level sensors may be used to determine a level of a polymer solution in one or more of the mixing chambers and may communicate with a system controller, which controls various system operations. For example, in response to a level sensor's reading, the controller may increase or decrease a rate at which wetted polymer is added to the first mixing chamber 106A.

Although five chambers 106 A-E are shown in the tank assembly 106, any number of chambers can be used. For example, the number of chambers may depend on a property associated with the polymer hydration process like a minimum or maximum desired polymer concentration or fluid pressure. Moreover, although the chambers are shown as being similarly sized, chamber size may differ within the tank assembly 106. Additionally, according to embodiments, the chambers 106A-E and baffles 122 may be configured to optimize progressive flow versus viscosity, and may be adjustable to progressive viscosity changes, relevant to flow (time) to hydrate (uncoil) the molecular chain. For example, in embodiments, the lower opening 124 may have a different size than the upper opening 126. Corresponding openings in adjacent tanks may have differing sizes.

In embodiments, the openings may be adjustable, manually and/or automatically, e.g., by moving a sliding wall panel up or down to enlarge or contract the opening. Embodiments may include a controller for facilitating a feedback control system that may be configured to automatically adjust the height and/or width of any one or more of the openings.

Figure 4:
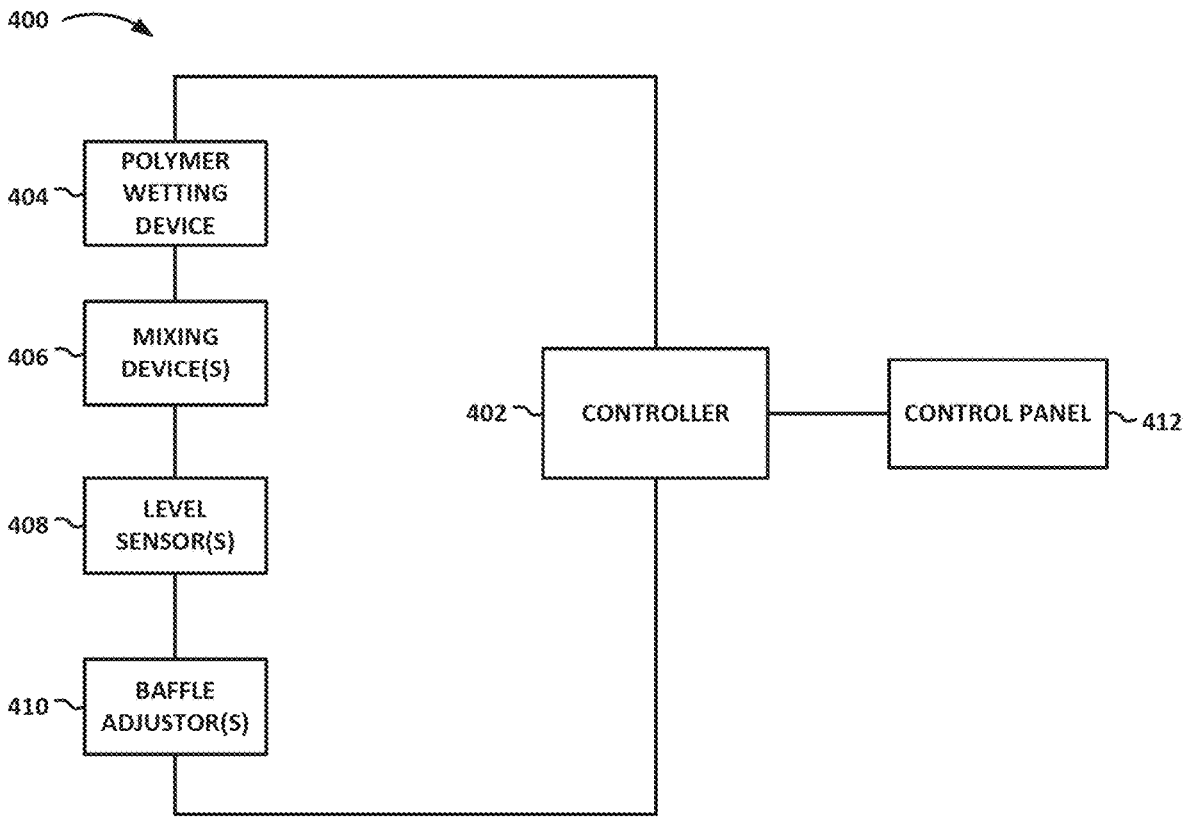
FIG. 4 is a block diagram depicting an illustrative operating environment, in accordance with embodiments of the disclosure.

FIG. 4 is a block diagram depicting an illustrative operating environment 400 in accordance with embodiments of the disclosure. The operating environment 400 may be, be associated with, include, or be included within a polymer hydration system such as, for example the system 100 depicted in FIG. 1. As illustrated, the operating environment 400 includes a controller 402 configured to control operations of a polymer wetting device 404 that wets polymer particles and feeds the wetted polymer to a first mixing chamber (e.g., the first mixing chamber 106A depicted in FIGS. 1-3. The polymer wetting device 404 may receive a measured amount (e.g., a measured volume or weight) of dry polymer from any type of dry material feeding mechanism such as, for example, an auger feeder. The polymer wetting device 404 proportionally controls addition of water, thereby wetting the polymer particles.

In embodiments, the controller 402 is configured to cause the polymer wetting device 404 to activate and/or deactivate and/or control a rate at which the polymer wetting device provides the wetted polymer to the first mixing chamber. For example, in embodiments, the controller 402 may cause the polymer wetting device 404 to provide the wetted polymer to the first mixing chamber at a first rate, determine that a condition is satisfied; and, in response to determining that the condition is satisfied, provide the wetted polymer to the first mixing chamber at a second rate. That is, the percentage, by weight, of polymer to water may be changed in a stepwise fashion from an initial percentage to a second percentage. The change in the percentage, by weight, may be due to a condition such as an amount of time that has passed, a certain water quality (measure in water clarity), a viscosity of the polymer solution in one or more of the mixing chambers, an output rate of the down stream made-down polymer (e.g., the flowrate of polymer-water mixture exiting a final (or intermediate) chamber, a level of the polymer solution in the first mixing chamber and/or a level of the polymer solution in an additional mixing chamber, and/or the like. In additional/alternative embodiments, the condition may be a high or low threshold, a range, a time period, and/or the like. The condition may be predetermined, dynamic, user-configurable, and/or the like.

In implementations, for example, the first rate may be greater than the second rate. In an aspects of the technology, the first and/or second rate may be no less than about 0.01 wt % and no greater than about 2.0 wt %, the first and/or second rate may be no less than about 1.0 wt % and no greater than about 2.0 wt, the first and/or second rate may be between 1.4 wt % and 1.9 wt % (e.g., about 1.5 wt %, about 1.6% wt, about 1.7% wt, etc.). The operating environment 400 may include one or more level sensors 408, each disposed in a mixing chamber and configured to determine a level of polymer solution in the mixing chamber. The controller 402 may also be configured to control one or more mixing devices 406 disposed within the one or more mixing chambers. For example, in embodiments, a first mixing device may be disposed in a first mixing chamber, a second device may be disposed in a second mixing chamber, and/or the like. The controller 402 may be configured to activate/deactivate the one or more mixing devices, control a rate at which each mixing device operates, and/or the like. For example, in embodiments, the controller 402 may be configured to cause a first mixing device to mix a volume of polymer solution more aggressively than at least one additional mixing device (e.g., a mixing device in a second mixing chamber), avoiding shear or damage to the polymer solution as it progressively hydrates. The first mixing device may be configured to mix the volume of polymer solution by rolling the volume of polymer solution within the first mixing chamber, while an additional mixing device may be configured to mix the volume of polymer solution by stirring the volume of polymer solution within an additional mixing chamber.

The controller 402 may be configured to dynamically control the one or more mixing devices 406 in response to any number of determinations that the controller 402 may be configured to make, based on one or more conditions of the system. Although not illustrated, the operating environment 400 may include any number of different types of sensors configured to determine any number of different conditions of the system such as, for example, temperature, fluid pressure, viscosity, flow rates, polymer concentrations, and/or the like. The sensors may include, for example, thermometers, samplers, optical sensors, transducers, and/or the like.

The controller 402 may also be configured to control one or more baffle adjustors 410. A baffle adjustor 410 may be associated with one or more baffles and may be configured to adjust one or more dimensions of one or more baffle inlets.

Figure 7:
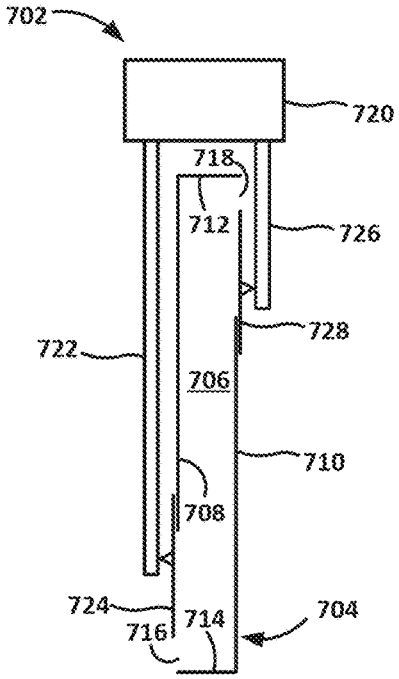
FIG. 7 illustrates a baffle adjustor configured to adjust a baffle.

Turning briefly to FIG. 7, an illustrative baffle adjustor 702 configured to adjust a baffle 702 is depicted, in accordance with embodiments of the disclosure. As shown in FIG. 7, the baffle may include an open interior region 706 partially enclosed by two parallel opposed side baffle walls 708 and 710, an upper baffle wall 712, and a lower baffle wall 714. A baffle inlet 716 is defined in a lower portion of the side baffle wall 708 (which also may form a back wall of a first mixing chamber), and a baffle outlet 718 is defined in an upper portion of the side baffle wall 710 (which also may form a front wall of a second mixing chamber).

The baffle adjustor 702 may include an actuator 720 configured to move a first arm 722 that is coupled to a first baffle door 724 to adjust the size of the baffle inlet 716, and a second arm 726 that is coupled to a second baffle door 728 to adjust the size of the baffle outlet 718. In embodiments, each baffle door 724 and 728 may be coupled to a different actuator 720. According to embodiments, any number of different types of mechanisms may be used to adjust the sizes of the baffle inlet 716 and outlet 718. In embodiments, the controller 402 depicted in FIG. 4 may be communicatively coupled to the actuator 720 to facilitate control thereof.

Returning to FIG. 4, the controller 402 may be operatively (e.g., communicatively) coupled to any number of various components of the operating environment 400. These connections (and any other connection contemplated between two or more components) may be wired, wireless, or a combination of these. The controller 402 may be, include, or be included in one or more processors, programmable logic controllers (PLCs), proportional-integral-derivative (PID) controllers, electronic circuits, and/or the like, and may be implemented in a computing device (e.g., a laptop, a mobile device, a server, a control panel 412, and/or the like), integrated with the polymer feeder 404, and/or the like. The controller 402 may be implemented using hardware, software, firmware, and/or a combination of these. In embodiments, the controller 402 may be configured to dynamically adjust the polymer feed rate, mixing speed, and/or baffle size, in response to any number of different conditions, optimizations, feedback control loops, and/or the like. It will be appreciated by individuals having skill in the relevant arts that the controller 402 may be configured to implement pre-set capabilities, user-configurable inputs and outputs, bidirectional communications, security paradigms, event logging, transactions, automatic controls, programmable controls, and/or the like.

The controller 402 may be configured to receive, and act in accordance with, input from a user and/or other device (e.g., via the control panel 412). The control panel 412 may be, be similar to, include, or be included in any control panel, controlling computing device, control station, and/or the like, associated with one or polymer hydration (e.g., make-down) systems, as described herein. In embodiments, the control panel 412 may include any number of different types of input devices and/or output devices. The controller 402 may be disposed in, integrated with, and/or coupled to (e.g., physically and/or communicatively) the control panel 412. The control panel 412 may include panel indicator lights, security components, manual controls, and/or the like, that enable a user to obtain information and/or control any number of various aspects of the illustrative operating environment 400.

The illustrative operating environment 400 shown in FIG. 4 is not intended to suggest any limitation as to the scope of use or functionality of embodiments of the present disclosure. Neither should the illustrative operating environment 400 be interpreted as having any dependency or requirement related to any single component or combination of components illustrated therein. Additionally, various components depicted in FIG. 4 may be, in embodiments, integrated with various ones of the other components depicted therein (and/or components not illustrated), all of which are considered to be within the ambit of the present disclosure.

Figure 5:
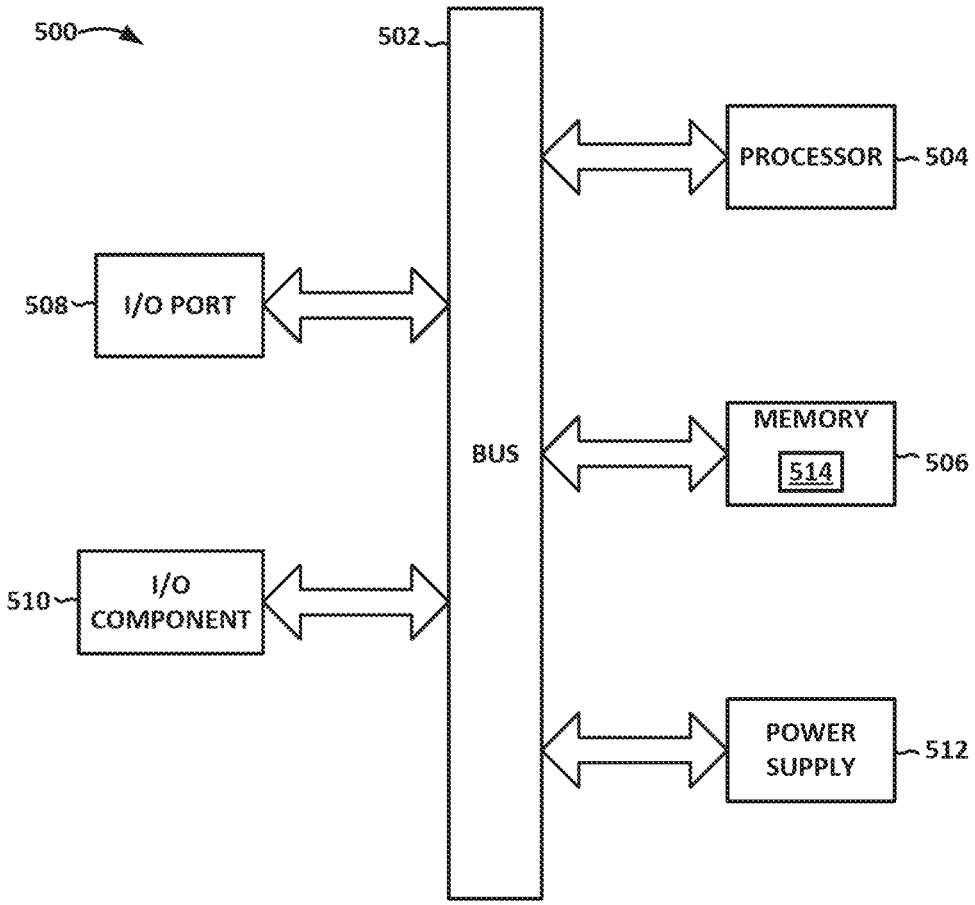
FIG. 5 is a block diagram depicting an illustrative computing device, in accordance with embodiments of the disclosure.

According to various embodiments of the disclosed subject matter, any number of the components depicted in FIG. 4 (e.g., aspects of the controller 402, polymer feeder 404, mixing devices 406, level sensors 408, baffle adjustors 410, and/or control panel 412) may be implemented on one or more computing devices. FIG. 5 is a block diagram depicting an illustrative computing device 500, in accordance with embodiments of the disclosure. The computing device 500 may include any type of computing device suitable for implementing aspects of embodiments of the disclosed subject matter. Examples of computing devices include specialized computing devices or general-purpose computing devices such "workstations," "servers," "laptops," "desktops," "tablet computers," "PLCs," "hand-held devices," "general-purpose graphics processing units (GPGPUs)," and the like, all of which are contemplated within the scope of FIG. 4, with reference to various components of the operating environment 400 and/or computing device 500.

In embodiments, the computing device 500 includes a bus 502 that, directly and/or indirectly, couples the following devices: a processor 504, a memory 506, an input/output (I/O) port 508, an I/O component 510, and a power supply 512. Any number of additional components, different components, and/or combinations of components may also be included in the computing device 500. The I/O component 510 may include a presentation component configured to present information to a user such as, for example, a display device, a speaker, a printing device, and/or the like, and/or an input component such as, for example, a microphone, a joystick, a satellite dish, a scanner, a printer, a wireless device, a keyboard, a pen, a voice input device, a touch input device, a touch-screen device, an interactive display device, a mouse, and/or the like.

The bus 502 represents what may be one or more busses (such as, for example, an address bus, data bus, or combination thereof). Similarly, in embodiments, the computing device 500 may include a number of processors 504, a number of memory components 506, a number of I/O ports 508, a number of I/O components 510, and/or a number of power supplies 512. Additionally any number of these components, or combinations thereof, may be distributed and/or duplicated across a number of computing devices.

In embodiments, the memory 506 includes computer-readable media in the form of volatile and/or nonvolatile memory and may be removable, nonremovable, or a combination thereof. Media examples include Random Access Memory (RAM); Read Only Memory (ROM); Electronically Erasable Programmable Read Only Memory (EEPROM); flash memory; optical or holographic media; magnetic cassettes, magnetic tape, magnetic disk storage or other magnetic storage devices; data transmissions; and/or any other medium that can be used to store information and can be accessed by a computing device such as, for example, quantum state memory, and/or the like. In embodiments, the memory 506 stores computer-executable instructions 514 for causing the processor 504 to implement aspects of embodiments of system components discussed herein and/or to perform aspects of embodiments of methods and procedures discussed herein.

The computer-executable instructions 514 may include, for example, computer code, machine-useable instructions, and the like such as, for example, program components capable of being executed by one or more processors 504 associated with the computing device 500. Program components may be programmed using any number of different programming environments, including various languages, development kits, frameworks, and/or the like. Some or all of the functionality contemplated herein may also, or alternatively, be implemented in hardware and/or firmware.

The illustrative computing device 500 shown in FIG. 5 is not intended to suggest any limitation as to the scope of use or functionality of embodiments of the present disclosure. Neither should the illustrative computing device 500 be interpreted as having any dependency or requirement related to any single component or combination of components illustrated therein. Additionally, various components depicted in FIG. 5 may be, in embodiments, integrated with various ones of the other components depicted therein (and/or components not illustrated), all of which are considered to be within the ambit of the present disclosure.

Figure 6:
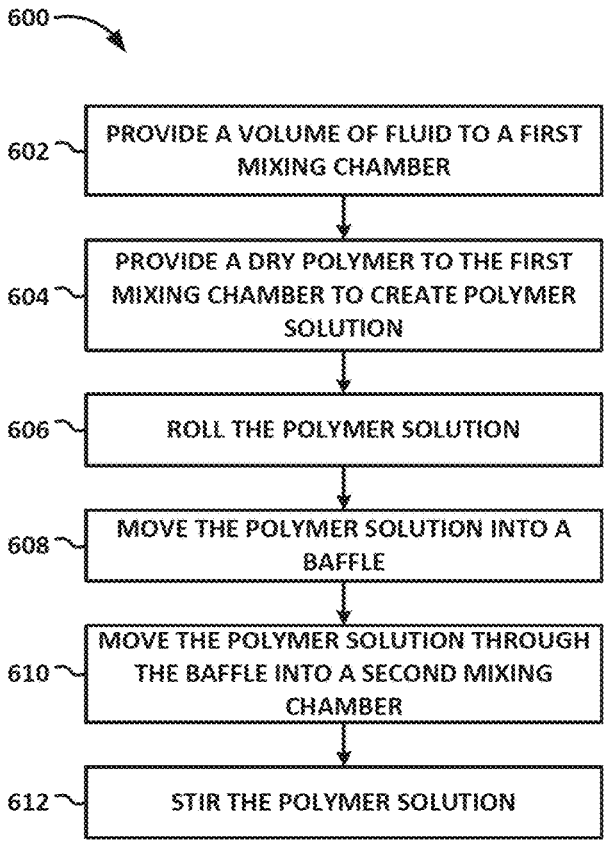
FIG. 6 is a flow diagram depicting an illustrative method of hydrating polymers using multiple mixing chambers, in accordance with embodiments of the disclosure.

As described above, embodiments of the subject matter disclosed herein include systems of mixing chambers for hydrating polymers. FIG. 6 is a flow diagram depicting an illustrative method 600 of hydrating a dry polymer using a number of mixing chambers, in accordance with embodiments of the disclosure. In embodiments, adjacent mixing chambers may be operatively coupled by an under-over baffle, and each mixing chamber may include an open interior bounded by a number of walls having a generally rectangular configuration, where adjacent walls are coupled by rounded corners. In embodiments, the system may include at least two mixing chambers such as, for example, two mixing chambers, three mixing chambers, four mixing chambers, five mixing chambers, and/or the like. Embodiments of the method 600 may include determining a number of mixing chambers to include in the system based on a property associated with the polymer hydration process. The property may include, for example, at least one of a minimum desired polymer concentration and a maximum desired polymer concentration, a fluid pressure, and/or the like.

Embodiments of the method 600 include providing a volume of fluid to a first mixing chamber (block 602) and providing a wetted polymer solution to the first mixing chamber to create a volume of polymer solution (block 604). In embodiments, providing the wetted polymer to the first mixing chamber may include providing the wetted polymer to the first mixing chamber at a first rate, determining that a condition is satisfied, and, in response to determining that the condition is satisfied, providing the wetted polymer to the first mixing chamber at a second rate. In embodiments, the first rate may be greater than the second rate; and the second rate may be no less than about 0.01 wt % and no greater than about 2.0 wt %. In embodiments, the second rate may be no less than about 1.0 wt % and no greater than about 2.0 wt %. In embodiments, the second rate may be, for example, between 1.4 wt % and 1.9 wt % (e.g., about 1.5 wt %). The condition may include, for example, at least one of an amount of time and a level of the polymer solution in the first mixing chamber.

As shown in FIG. 6, the method 600 may further include rolling, using a first mixing device disposed in the first mixing chamber, the volume of polymer solution (block 606). The volume of polymer solution is moved from the first mixing chamber into a baffle via a baffle inlet (block 608), through the baffle and into a second mixing chamber via a baffle outlet (block 610). Embodiments of the method 600 further include stirring, using a second mixing device disposed in the second mixing chamber, the volume of polymer solution (block 612).

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

We claim:

1. A system for hydrating a dry polymer, comprising:

a tank assembly having a plurality of mixing chambers, wherein adjacent mixing chambers are operatively coupled by an under-over baffle, and wherein each of the plurality of mixing chambers comprises an open interior bounded by a plurality of walls having a generally rectangular configuration, wherein adjacent walls are coupled by rounded corners;

the plurality of mixing chambers and the under-over baffle further comprising:

a first mixing chamber comprising:

a polymer inlet through which wetted polymer is provided to the first mixing chamber;

a first baffle net defined in a lower portion of a back wall of the first mixing chamber;

a first mixing device comprising a roller configured to circulate fluid in a vertical direction; and a second mixing chamber comprising:

a first baffle outlet defined in an upper portion of a front wall of the second mixing chamber;

a second baffle net defined in a lower portion of a back wall of the second mixing chamber; and a second mixing device comprising an impeller configured to circulate fluid in a horizontal direction; and a first fluid conduit extending between the first baffle inlet and the first baffle out operatively coupling the first mixing chamber to the second mixing chamber.

2. The system of claim 1, wherein the plurality of walls and rounded corners comprise:

a rectangular front wall;

a first side wall oriented substantially perpendicularly to the front wall;

a first curved corner wall extending between a first edge of the front wall and a first edge of the first side wall;

a second side wall oriented substantially perpendicularly to the front wall;

a second curved corner wall extending between a second edge of the front wall and a first edge of the second side wall;

a rectangular back wall parallel to the front wall;

a third curved corner wall extending between a first edge of the back wall and a second edge of the first side wall;

a fourth curved corner wall extending between a second edge of the back wall and a second edge of the second side wall; and a lower wall coupled to a lower end of each of the front wall, the back wall, and the side walls, wherein the lower wall is oriented substantially perpendicularly to the front, back, and side walls.

3. The system of claim 2, wherein the first fluid conduit comprises an open interior region partially enclosed by an outside surface of the back wall of the first mixing chamber, an outside surface of the front wall of the second mixing chamber, two parallel opposed side baffle wads, an upper baffle wall, and a lower baffle wall.

4. The system of claim 2, wherein the first baffle inlet comprises an opening having a first end and a second end, wherein the first end is disposed at or near the first edge of the back wall, and wherein the second end is disposed at or near the second edge of the back wall.

5. The system of claim 4, wherein the opening has a rectangular shape or an elliptical shape.

6. The system of claim 4, wherein a size of the opening is adjustable.

7. The system of claim 2, further comprising a level sensor operatively coupled to the first mixing chamber, wherein the level sensor is configured to determine a level of a polymer solution in the first mixing chamber.

8. The system of claim 7, further comprising a controller configured to control one or more operations performed by the system, wherein the level sensor is further configured to communicate the determined level of the polymer solution in the first mixing chamber to the controller.

9. The system of claim 8, wherein the controller is further configured to implement a feedback control loop based at least in part on the determined level of the polymer solution in the first mixing chamber, wherein the feedback control loop is used to adjust a rate at which the wetted polymer is added to the first mixing chamber.

10. The system of claim 1, wherein the first mixing device is configured to mix the volume of polymer solution more aggressively than the second mixing device.

11. A method of hydrating a dry polymer, using a plurality of mixing chambers, wherein adjacent mixing chambers are operatively coupled by an under-over baffle, and wherein each of the plurality of mixing chambers comprises an open interior bounded by a plurality of walls having a generally rectangular configuration, wherein adjacent walls are coupled by rounded corners, the method comprising:

providing a volume of fluid to a First mixing chamber of the plurality of mixing chambers;

providing un-hydrated wetted polymer particles to the first mixing chamber to create a volume of polymer solution;

rolling, using a first mixing device disposed in the first mixing chamber, the volume of polymer solution to circulate the volume of polymer solution in a vertical direction;

moving the volume of polymer solution from the first mixing chamber into a baffle via a baffle inlet, wherein the baffle inlet is defined in a lower portion of a back wall of the first mixing chamber;

moving the volume of polymer solution through the baffle and into a second mixing chamber of the plurality of mixing chambers via a baffle outlet, wherein the baffle outlet is defined in an upper portion of a front wall of the second mixing chamber; and stirring, using a second mixing device disposed in the second mixing chamber, the volume of polymer solution to circulate the volume of polymer solution in a horizontal direction.

12. The method of claim 11, the baffle comprising an open interior region partially enclosed by an outside surface of the back wall of the first mixing chamber, an outside surface of the front wall of the second mixing chamber, two parallel opposed side baffle walls, an upper baffle wall, and a lower baffle wall.

13. A system for hydrating a dry polymer, comprising:

a polymer wetting device configured to dispense a measured amount of a wetted polymer;

a tank assembly having a plurality of mixing chambers, wherein adjacent mixing chambers are operatively coupled by an under-over baffle, and wherein each of the plurality of mixing chambers comprises an open interior bounded by four walls wherein adjacent walls are coupled by rounded corners, the plurality of mixing chambers comprising at least a first mixing chamber and a last mixing chamber, wherein the polymer wetting device is coupled to the first mixing chamber and configured to dispense the measured amount of the wetted polymer into the first mixing chamber;

a first mixing device disposed within at least one of the plurality of mixing chambers comprising a roller configured to circulate fluid in a vertical direction and a second mixing device disposed within at least one of the plurality of mixing chambers comprising an impeller configured to circulate fluid in a horizontal direction;

a hydrated polymer discharge mechanism configured to discharge the hydrated polymer from the last mixing chamber; and a controller configured to control operation of at least one of the polymer wetting device, the hydrated polymer discharge mechanism, and the first mixing device and second mixing device.

* * * * *